US006467703B1

(12) United States Patent
Pearl, II et al.

(10) Patent No.: US 6,467,703 B1
(45) Date of Patent: Oct. 22, 2002

(54) MULTIPLE FLAME TORCH TIP

(75) Inventors: David S. Pearl, II, Fort Lauderdale; Frank G. Smith, Davie, both of FL (US)

(73) Assignee: Uniweld Products, Inc., Fort Lauderdale, FL (US)

( * ) Notice: Subject to any disclaimer, the term of this patent is extended or adjusted under 35 U.S.C. 154(b) by 199 days.

(21) Appl. No.: 09/150,855

(22) Filed: Sep. 10, 1998

(51) Int. Cl.[7] ..... B05B 1/26

(52) U.S. Cl. ..... 239/543; 239/544; 239/545; 239/548; 239/559; 239/566; 239/567; 239/589; 239/DIG. 2; 126/39 E; 431/354

(58) Field of Search ..... 239/543, 544, 239/545, 548, 559, 566, 567, 589, DIG. 2; D26/8; 431/354; 126/39 E; 65/113, 120

(56) References Cited

U.S. PATENT DOCUMENTS 1,539,420 A * 5/1925 Kerr ..... 431/354 X
1,560,248 A * 11/1925 Kerr ..... 239/543 X
1,948,807 A * 2/1934 Taylor ..... 239/543
2,593,295 A * 4/1952 Granfield ..... 239/545 X
2,608,031 A * 8/1952 Barnes et al. ..... 65/120 X
3,091,401 A * 5/1963 Hruby, Jr. ..... 239/567 X
3,170,171 A * 2/1965 Mayhew et al. ..... 239/567 X
3,326,551 A * 6/1967 Clarke ..... 239/567 X

* cited by examiner

*Primary Examiner*—Robin O. Evans
(74) *Attorney, Agent, or Firm*—Nields & Lemack

(57) ABSTRACT

Torch tip for a torch, said tip adapted to be in fluid communication with a fuel gas and oxygen source for generating a flame, the torch tip including a tubular or substantially tubular body having a plurality of spaced orifices therein, at least one of the orifices being formed in a planar surface so as to allow the formation of a circular orifice therein, the orifice thereby emitting, in operation, a stable and even flame. In a preferred embodiment, all of the orifices are so formed, and direct a flame towards a common point.

5 Claims, 2 Drawing Sheets

MULTIPLE FLAME TORCH TIP

BACKGROUND OF THE INVENTION

The present invention relates to a torch, and in particular to a torch tip, designed for easy heating, brazing and soldering around tubular objects such as pipes, and in close quarters.

U.S. Pat. No. 4,191,333, the disclosure of which is incorporated herein by reference, discloses a hook-like flame tip including an arcuate body extending for a full half-circle with a short straight section with its distal end closed by a cap, and an angular rear terminal threaded for engagement with a conventional coupling connecting the flame tip to a conventional torch. The arcuate body includes a plurality of spaced radial flame apertures which direct flame jets to the object being heated, brazed or soldered, for example.

Similarly, U.S. Pat. No. 5,755,568 discloses a multiflame torch tip including an elongated tubular handle or housing that mounts to a torch, a tubular stem, and a tip head joined to the tip stem, the tip head being arcuately curved through an angle of at least 240° and having two opposed closed terminal ends. The tip head includes a plurality of spaced outlet orifices which direct flame jets to the object being acted upon.

Flame stability and accurate direction of the flame are important considerations in such torch tips, especially since such torch tips are typically used in tight quarters where access to the object to be acted upon is difficult, and burning of objects in close proximity to the object being heated must be avoided.

It is therefore an object of the present invention to provide a torch including a multiflame torch tip that exhibits improved flame stability and flame direction accuracy.

SUMMARY OF THE INVENTION

The problems of the prior art have been overcome by the present invention, which provides a torch including a torch tip adapted to be in fluid communication with a fuel gas and oxygen source for generating a flame, the torch tip including a tubular or substantially tubular body having a plurality of spaced orifices therein, at least one of the orifices being formed in a flat or planar surface so as to allow the formation of a circular orifice. So reducing the curvature of the torch tip in proximity to the orifices allows the formation of a substantially circular hole, thereby emitting, in operation, a stable and even flame. In a preferred embodiment, all of the orifices are so formed, and direct a flame towards a common point for soldering or otherwise heating tubing such as a pipe by substantially surrounding it.

DETAILED DESCRIPTION OF THE INVENTION

Figure 1:
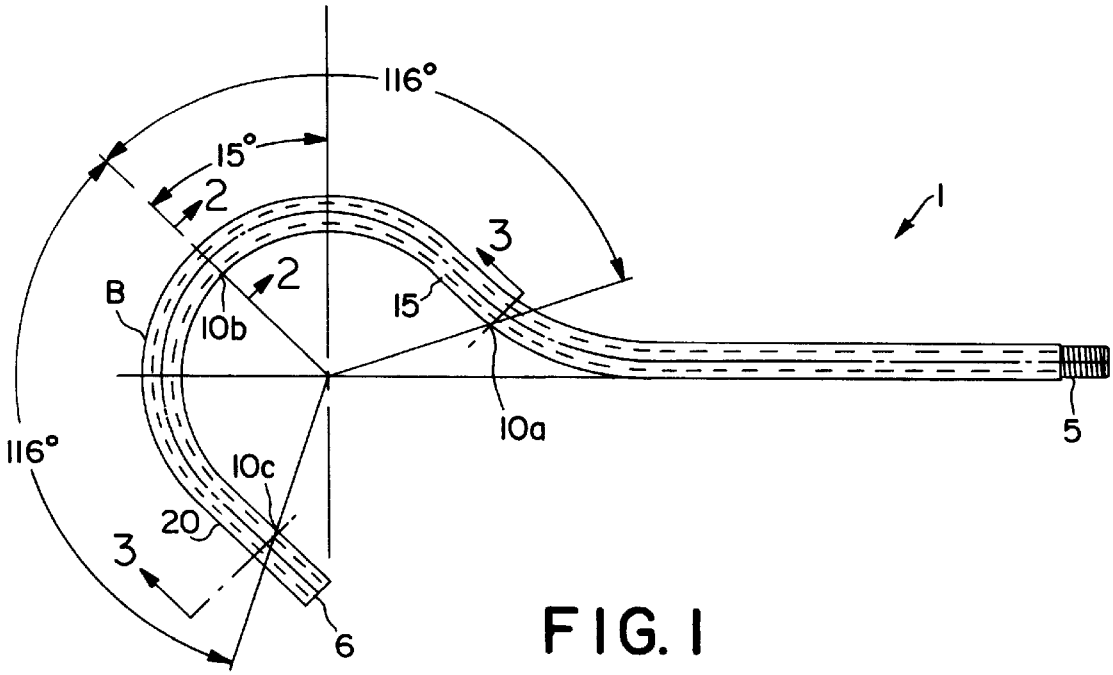
FIG. 1 is a cross-sectional view of a torch tip in accordance with the present invention.

Turning first to FIG. 1, torch tip 1 is shown having a substantially tubular shape in cross-section, and can be viewed as an elongated tube having two sections A and B distinguished by their shape and together forming a question mark ("?") design. Section A is a longitudinally elongated tip stem, which preferably is linear or substantially linear, terminating at one end in a threaded portion 5 for removable engagement to a torch member such as with a compression fitting and a nut (not shown). Those skilled in the art will appreciate that other means of coupling the tip stem to the torch member can be used, such as a snap fit. Appropriate positioning of the tip stem A with respect to the torch member can be made prior to securing the tip stem on the torch member. The design of the torch member is not particularly limited, and can be conventional. In general, a torch member having an oxygen source passageway, a fuel gas (such as acetylene, MAPP or propane) passageway, and suitable valving for controlling the flow of oxygen and fuel gas is appropriate, such as that disclosed in U.S. Pat. No. 3,279,701, the disclosure of which is incorporated herein by reference. The tip stem A has an internal bore that is preferably uniform and circular in cross-section, to allow for smooth passage of the fuel gas and oxygen source mixture therethrough from the torch member to the tip head B. In the embodiment shown, the tip stem A and the tip head B are one continuous piece, thereby also enhancing uniform flow of the fuel gas and oxygen source. However, those skilled in the art will appreciate that other configurations are possible, such as wherein the tip stem A and tip head B are discontinuous yet coupled to one another such as by welding, thereby providing fluid communication therebetween.

Suitable fuel gases for use with the torch include acetylene, propane and MAPP. Suitable oxygen sources include pure oxygen and air.

The tip head section B is arcuate with respect to the tip stem A. In the embodiment shown, the head B is curved through an angle of about 232° (measured from orifice 10*a* to orifice 10*c*), although smaller or larger (eg., 250–260°) angles are suitable. The distal end 6 of the head is capped or preferably welded closed.

A plurality of flame outlet orifices are formed through the surface of the tip head B. The number of outlet orifices depends upon the size of the particular tip head; for example, in an embodiment where the length of the torch tip 1 (measured from the stem end 5 to the farthest point of the tip head B) is about 5 inches, preferably three equally spaced outlet orifices 10*a*, 10*b* and 10*c* are provided, the spacing between each orifice being 116°. In an embodiment where the length of the torch tip 1 (measured from the stem end 5 to the farthest point of the tip head B) is about 7⅝ inches, preferably five equally spaced outlet orifices are provided, the spacing between each orifice being 63°6'. Similarly, in an embodiment where the length of the torch tip 1 (measured from the stem end 5 to the farthest point of the tip head B) is about 10 13/16 inches, preferably nine equally spaced outlet orifices are provided, the spacing between each orifice being 32°20'. Those skilled in the art will appreciate that the foregoing is provided by way of illustration, and the size of the torch tip, the number of orifices, and the spacing between them are not particularly limited. Preferably the orifices are equally spaced.

In view of the curvature of the tip head B, the formation of round orifices through the head by drilling or other suitable means is difficult. In accordance with the present invention, the curvature of the tip head B is reduced or eliminated (relative to a circular cross-section) at least in the proximity of the desired location of each of the orifices in order to optimize the roundness of each orifice. For example, a flat or planar indentation is formed in the outer peripheral surface of the tip head B, such as by stamping, in each of the areas where the orifices are to be created. The size of each flat surface should be at least as large as the diameter of the respective orifice to be formed therein, and is preferably slightly larger. A suitable size for an orifice diameter of from about 22 to 32 mils is ⅛" square. By way of further illustration, the distance from the center of the bore of the tip head B to the flat surface 12 (which flat surface can be considered a chord of the circle formed by the tip head B) is 0.070" for a tip head B having an outside diameter of 3/16". The flat or planar surfaces allow for formation of a round or substantially round (in cross-section) orifice at an acute compound angle; drilling through a standard tube without such a planar surface results in the formation of an oval, rather than a round, orifice. Round orifices are preferred for flame stability. Where the fuel gas is acetylene, a suitable orifice diameter is 22±5 mils. Where the fuel gas is propane of MAPP, a suitable orifice diameter is 32±5 mils. Preferably each orifice is uniform in diameter throughout its length.

In an alternative embodiment, the curvature of the tip head B is reduced or eliminated in the desired areas by removing a portion of the wall thickness of the tip head B, such as by cutting or machining.

Figure 5:
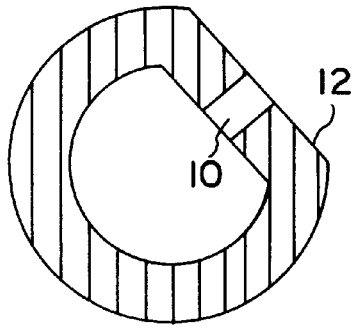
FIG. 5 is a cross-sectional view of another embodiment of the torch tip in accordance with the present invention.

In yet a further embodiment, the configuration of the tubular tip head B can be chosen (or formed) such that a portion of its outer periphery spaced from the bisecting plane C—C is planar throughout its entire arcuate length, giving the tip head B a cross-section along its entire arcuate length as shown in FIG. 5.

Figure 2:
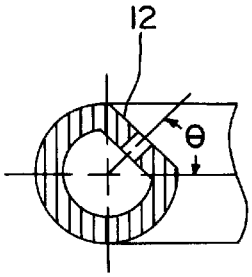
FIG. 2 is a view of the torch tip taken along line 2—2 of FIG. 1.
Figure 3:
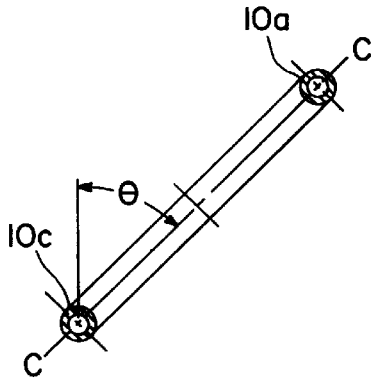
FIG. 3 is a view of the torch tip taken along line 3—3 of FIG. 1.
Figure 4:
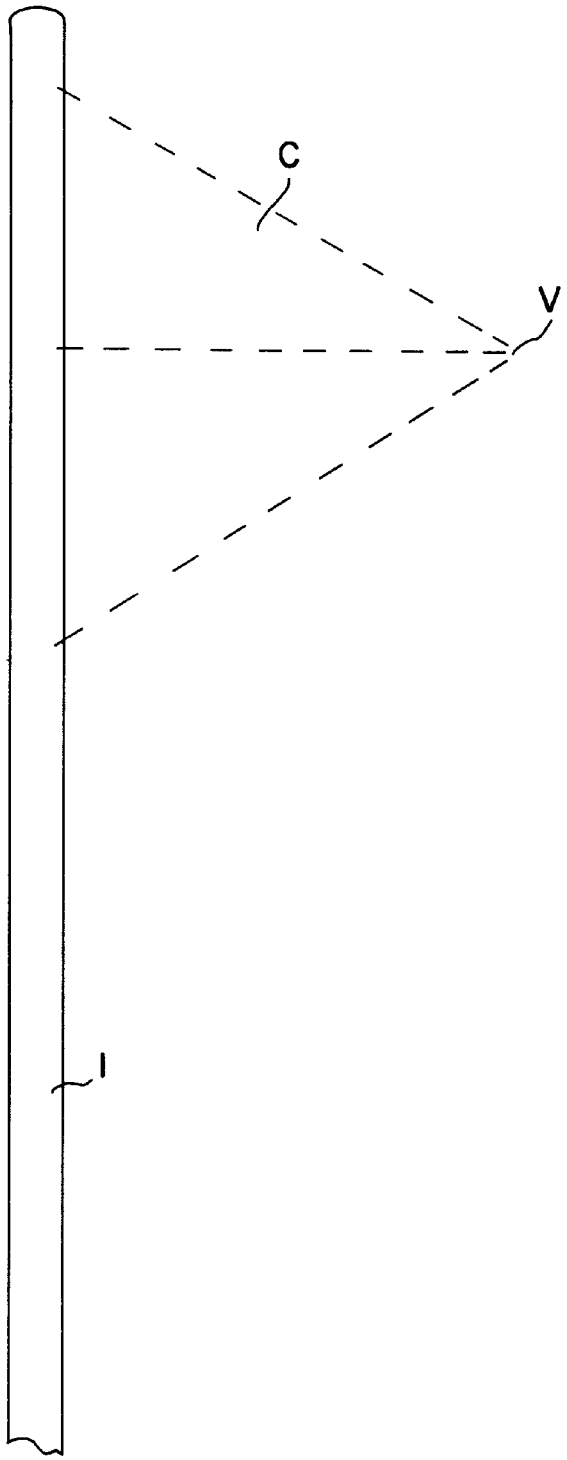
FIG. 4 is a side view of a torch tip showing the direction of flame emission in accordance with the present invention.

As can be seen from FIGS. 2 and 3, the particular location of the orifices 10 and planar surfaces 12 is preferably offset at an angle θ from the cutting plane C—C of the arcuate portion of the tip head B. A suitable offset angle θ, measured from the center of the orifice 10 to the bisecting plane C—C, is from about 30° to about 60°, most preferably about 45°. The flame jets emanating from the orifices 10 thus converge at a common point defined by the vertex V of a cone C, as illustrated in FIG. 4. So offsetting the location of the orifices 10 directs the flame jets emanating therefrom away from the cutting or bisecting plane C—C, thereby reducing the chance of overheating of the torch tip and burning of other objects located on the side of the tip opposite from the direction of the flame jets (i.e., objects located to the left of the torch tip 1 as it appears in FIG. 4).

In the embodiment shown in FIG. 1 (and as described in the aforementioned U.S. Pat. No. 4,191,333), the tip head B has two substantially linear or linear sections 15 and 20 parallel to one another. In the case where the tip head B has sections so configured, any flats 12 and orifices 10 formed in these sections must be angled inwardly towards the vertex V in order to appropriately direct the flame jets emanating therefrom. These orifices are particularly difficult to form were flats 12 not present.

What is claimed is:

1. A torch tip for a torch, said tip comprising:

a stem having an inlet end, and a head in fluid communication with said stem spaced from said inlet end, said head extending arcuately and comprising a plurality of spaced outlet orifices each having a center, said head having a bisecting plane and a circular cross-section except in reduced in curvature portions where said plurality of spaced outlet orifices are formed, said reduced in curvature portions being a chord of said circular cross-section, said centers of said orifices each being located at an angle of from about 30° to about 60° to said bisecting plane.

2. The torch tip of claim 1, wherein said portion that is reduced in curvature is planar.

3. The torch tip of claim 1, wherein said angle is about 45°.

4. The torch tip of claim 1, wherein said torch tip is coupled to a torch member for distributing fuel gas and an oxygen source to said torch tip, said fuel gas and said oxygen source producing, upon ignition, flame jets that emanate from said plurality of spaced outlet orifices and converge at a common point.

5. The torch tip of claim 4, wherein said flame jets emanate from said plurality of spaced orifices in the shape of a cone, and wherein said common point is the vertex of said cone.

* * * * *